United States Patent [19]

Tanaka

[11] Patent Number: 4,873,143

[45] Date of Patent: Oct. 10, 1989

[54] WATER-SWELLABLE FIBER

[75] Inventor: Kojii Tanaka, Okayama, Japan

[73] Assignee: Japan Exlan Company Limited, Osaka, Japan

[21] Appl. No.: 246,959

[22] Filed: Sep. 20, 1988

Related U.S. Application Data

[63] Continuation-in-part of Ser. No. 32,720, Apr. 1, 1987, abandoned.

[30] Foreign Application Priority Data

May 6, 1986 [JP] Japan ..... 61-104140

[51] Int. Cl.[4] ..... D02G 3/00

[52] U.S. Cl. ..... 428/373; 428/364; 428/374; 428/375; 428/394; 428/395; 428/400; 8/115.5; 8/115.6

[58] Field of Search ..... 428/364, 373, 374, 375, 428/394, 395; 8/115.5, 115.6

[56] References Cited

U.S. PATENT DOCUMENTS

| | | | |
|---|---|---|---|
| 3,460,897 | 8/1969 | Lowes | 8/634 X |
| 4,366,206 | 12/1982 | Tanaka | 428/364 X |
| 4,562,114 | 12/1985 | Sawanishi et al. | 428/400 X |
| 4,600,407 | 7/1986 | Huber | 428/364 X |

*Primary Examiner*—Lorraine T. Kendell

*Attorney, Agent, or Firm*—Wenderoth, Lind & Ponack

[57] ABSTRACT

This invention provides a water-swellable fiber which is produced from a fiber having a particular cross-sectional structure and containing and linking carboxyl groups thereto at a prescribed degree of neutralization by causing a particular quantity of a specific alkali to adhere to said fiber. The fiber of the invention has no problems in respect to agglutination among the filaments upon storage, no problems upon processing, such as wet system paper-making, and no problems in neutralization thereof. This fiber exhibits sufficient water-swelling properties in use.

2 Claims, No Drawings

WATER-SWELLABLE FIBER

This application is a continuation-in-part of application Ser. No. 032,720, filed Apr. 1, 1987, now abandoned.

Sheets, non-woven fabrics, yarns, knit or woven fabrics, etc. are frequently demanded, that is to say, the so-called fibrous hydrogels are earnestly desired. As a representative example of such fibrous hydrogels there may be mentioned a fiber described in Japanese Patent Publication No. 10508/1983, which is composed of a hydrogel outer layer part and an inner part layer of an acrylonitrile (hereinafter referred to as AN) polymer, etc., and contains 0.5–4.0 m mol/g of salt type carboxyl groups represented by —COOX (wherein X is an alkalimetal or $NH_4$), this fiber being given a high degree of water-swelling properties without impairing the physical properties of the fiber such as the strength, the elongation, etc.

Incidentally, when a large amount of salt type carboxyl groups is present in the outer layer part of the fiber, the fiber will become highly hygroscopic, and this causes filament agglutination at the time of storage.

Also, when such a fiber is subjected to a wet system paper making process, since it is water-swellable, the water filtration and the separation from wires are very bad. In addition, it is impossible to subject the fiber to a drainage operation in a press process.

Therefore, a method has been thought out in which the salt type carboxyl groups are once converted to acid type (—COOH) to lower the water-swelling power and the fiber so treated is subjected to processing, such as paper making and thereafter the fiber is neutralized again. In this case, when the fiber is neutralized with a caustic soda solution for example, not only is drying very difficult, but also agglutination among filaments is liable to occur in the drying step. Therefore, it has been attempted to neutralize the fiber with a gas such as ammonia, amine, etc. But this neutralization requires a long time, and in addition, entails various problems in operation such as the existence of bad odors, possible dangers as a result of the use of such gases, and handling problems.

Therefore, the object of this invention is to provide a fiber which has no problems of filament agglutination upon storage, no problems in processing, process such as in wet system paper making process, and no problems in the neutralization process, and which fiber exhibits a sufficient water swelling properties.

SUMMARY OF THE INVENTION

The object of this invention is attained by use of a water-swellable fiber exhibiting a degree of water-swelling of 2 times or more produced from a fiber (A) satisfying the following requirements (a)–(e):

(a) it is composed of a hydrophilic cross-linked polymer (I) and another polymer (II), (b) it has a cross-sectional structure such that at least a part of the polymer (I) is situated at the outer layer, (c) it contains carboxyl groups in a quantity of 0.1 m mol/g or more, (d) the degree of neutralization of the carboxyl groups is less than 0.2, and (e) its degree of water-swelling is 20 times or less, by causing to adhere to said fiber such a quantity of an alkalimetal hydroxide, amine, carbonate, hydrogen carbonate and/or borate that it will make the degree of neutralization of the carboxyl groups larger than that of the fiber (A) and larger than 0.02.

DETAILED DESCRIPTION OF THE INVENTION

First, it is necessary that the fiber (A) of this invention should be composed of a hydrophilic cross-linked polymer (I) for exhibiting the water-swelling power and another polymer (II) for retaining the requisite fiber physical properties. Also, it is necessary that the fiber (A) should have a cross-sectional structure such that at least a part of the polymer (I) is situated at the outer layer in order to exhibit the water-swelling power at its maximum. The proportion of the polymer (I) composing the fiber (A) can be suitably determined depending on the carboxyl group-linking and -containing state and its quantity, the cross-sectional structure of the polymers (I) and (II), the degree of water-swelling to be finally obtained, etc. However, from the viewpoint of providing a fiber having both water-swelling properties and sufficient fiber physical properties, the proportion is desirable to be generally less than 60% based on the total volume of the fiber, preferably in the range of from 5 to 50%.

Furthermore, the fiber (A) needs to contain and link carboxyl groups thereto in a quantity of 0.1 m mol/g or more, preferably from 0.3 to 4.0 m mol/g. When the quantity goes beyond the lower limit of this range, it is impossible to finally provide a fiber capable of exhibiting a degree of water-swelling of more than 2 times. When the quantity exceeds the upper limit, the fiber properties lower inevitably, The degree of neutralization of carboxyl groups needs to be less than 0.2, preferably less than 0.1, and the degree of water-swelling needs to be 20 times or less, preferably 10 times or less. When the fiber (A) goes out of these ranges, the problem of agglutination among filaments upon storage or upon drying is caused, and becomes impossible to conduct a wet system paper-making operation.

As the other polymer (II), any polymer may be used insofar as it is able to maintain the physical properties of the finally obtained fiber at a practical level. Such polymers include for example, AN polymers of which the AN content is more than 50 weight %, polymers of the class of polyvinyl chloride, polyamide, polyolefin, polystyrene, polyvinyl alcohol, etc.

As the method of producing the fiber (A), any may be employed insofar as a fiber satisfying the above-mentioned requirements (a)–(e). For example, methods described in Japanese Patent Publication Nos. 36699/1979 and 10508/1983 may be mentioned. Among others, the method described in Japanese Patent Publication No. 10508/1983 describes methods of making a host of fibers and uses an ordinary AN fiber (this method does not need to use an AN polymer copolymerized with a cross-linkable monomer or a bicomponent fiber) and can produce a fiber of which only the outer layer is hydrogelled, and which is efficiently given water-swelling properties efficiently, without impairing the fiber properties. Therefore, this method is favorble from both the industrial viewpoint and fiber properties. If necessary, the fiber thus obtained may be suitably post-treated for example acid-treated so as to satisfy the above-mentioned requirements (a)–(e).

In the next place, it is necessary to cause to adhere to the fiber (A) such a quantity of an alkali-metal hydroxide, amine, carbonate, hydrogen carbonate and/or borate that it will make the degree of neutralization of the carboxyl groups larger than that of the fiber (A) and larger than 0.02, desirably from 0.05 to 0.8, more desirably from 0.1 to 0.7. Only by using a fiber in which such a particular quantity of such an alkali has been caused to adhere, is it possible to provide a fiber which is able to exhibit a water-swelling power of more than 2 times, preferably more than 3 times at the final use time. The shape of the fibers (A) may be of any shape including short fiber, long fibers, webs, sheets of paper, non-woven fabrics, yarns, knits or woven fabrics, etc. However, the shape of a web, a sheet of paper, a non-woven fabric, or a knit or woven fabric is favorable because such a shape makes it possible to cause the alkali to adhere uniformly, and also does not cause any problems in the subsequent processing process. In this case, it is also permissible to suitably blend other natural, semi-synthetic or synthetic fibers.

Alkali-metal hydroxides have deliquescent properties and have bad effects on the human body. Also, amines which can be used in this invention including di- or triethyl amine, mono-, di- or tripropyl amine may cause problems because of their bad odor. Therefore, the use of the above-mentioned salts is favorable. When a divalent or higher metal is used as the cationic component composing the salt, there are many cases where an expected degree of water-swelling is not exhibited, Accordingly, it is desirable to use a salt whose cationic component is an alkali-metal such as Na, K, Li, etc. and $NH_4$.

The method of causing an alkali to adhere to the fiber (A) can be performed with an aqueous solution of the desired salt by a bath treatment, an impregnation treatment, a spray treatment, a foam treatment, etc. so as to cause a prescribed quantity of the alkali to adhere to the fiber. However, a spray treatment is preferable because of its ease in regulating the adhering quantity of the alkali and in drying and because of there are no problems of agglutination among filaments upon drying. As the an aqueous liquid, not only water but also a mixed solvent composed of water and a water-miscible organic solvent such alcohol or acetone, etc. may be used. The aqueous liquid does not need to be a solution, but may be a dispersion.

When causing a quantity of alkali to adhere so as to make the degree of neutralization of carboxyl groups 0.2 or more, the hygroscopic properties upon storage of the resulting fiber is heightened. Therefore, it is desirable that a quantity of alkali exceeding 0.2, preferably 0.15, should be caused to adhere to the surface of the fiber and be present in the form of alkali without being consumed for the neutralization of carboxyl groups. For this purpose, it is desirable to increase the viscosity or the concentration of the aqueous liquid.

Since the fiber of this inention has a cross-sectional structure such that at least a part of the hydrophilic crosslinked polymer (I) is situated at the outer layer, when the fiber is used (that is, when it is brought into contact with water), it is presumed that because of this it exhibits effective water absorption and water swelling properties.

Furthermore, since a specific quantity of a particular alkali is cause to adhere, it is presumed that the neutralization of carboxyl groups comes to completion at the same time in parallel with water absorption, with the result that it exhibits a sufficient water-swelling properties.

It is an effect of this invention worthy of special mention that, as described above, the invention provides a fiber in which agglutination among filaments upon storage does not occur and which exhibits sufficient water-swelling properties at the time of use.

Also, this invention can provide a water-swellable fiber without any problems occurring in the processing thereof, such as in wet system paper making process and without any problems occuring in production such as the drying and neutralization steps. These are also characteristic advantages of this invention.

EXAMPLES

This invention will be explained in detail by way of Examples in the following. Parts and percentages in the Referential Examples and Examples of practice are by weight unless otherwise indicated. The degree of water-swelling, quantity and degree of neutralization of carboxyl groups, and degree of agglutination were measured and calculated by the following methods:

(1) Degree of water-swelling (times)

About 0.1 g of a sample fiber is immersed in pure water and is maintained at 25° C. After 24 hours, the fiber is wrapped in a nylon cloth (200 mesh), and the water among the filaments is removed by a centrifuge for 5 minutes at 300 G (G is the acceleration of gravity). The weight of the sample thus prepared is measured ($W_1$ g). The sample is then dried in a vacuum drier at 80° C. until it reaches a constant weight and the weight is measured ($W_2$ g). From the results of the above measurement, the degree of water-swelling is calculated from the following formula. Therefore, it is a numerical value showing how many times the fiber's own weight of water can be absorbed and retained.

$$\text{Degree of water-swelling} = \frac{W_1 - W_2}{W_2}$$

(2) Quantity of carboxyl groups (m mol/g)

About 0.25 g of a thoroughly dried sample is weighed accurately (X g). After adding 100 ml water to this sample, an aqueous 1 N hydrochloric acid is added to bring the pH to 2. Then in the usual way, the titration curve is determined using an aqueous 0.1 N caustic soda solution. From this titration curve, the quantity of the caustic soda solution consumed by the carboxyl groups is determined (Y cc). From the results of the above measurement, the quantity of carboxyl groups is calculated by the following formula:

$$\text{Quantity of carboxyl groups} = \frac{0.1\ Y}{X}$$

When polyvallent cations are contained, the quantity of the cations are determined in the usual way, and the above formula must be corrected with this quantity.

(3) Degree of neutralization of carboxyl groups

About 0.25 g of a thoroughly dried sample is weighed accurately ($X_1$ g). After adding 100 ml water and 0.5 g sodium chloride to this sample, with an aquous 0.1 N caustic soda solution, titration is performed in the same way as in the above (2) to determine the consumed quantity of the aqueous caustic soda solution ($Y_1$ cc). The degree of neutralization of carboxyl groups is calculated by the following formula:

$$\text{(Quantity of carboxylic acid: m mol/g)} = \frac{0.1\ Y_1}{X_1}$$

-continued (Degree of neutralization) =

$$\frac{\left(\text{Quantity of carboxyl groups}\right) - \left(\text{Quantity of carboxylic acid}\right)}{\text{(Quantity of carboxyl groups)}}$$

(4) Degree of agglutination among filaments

Ten sheets of paper (10 cm×10 cm in area for one sheet; 75 g/m$^2$) which have been caused to stand in a decicator conditioned at 20° C., 65% RH for one week were pulled up and were caused to stand under a load of 10 kg for 24 hours. The load was then removed, and the sheets were separated one from another by hand. The degree of agglutination was judged from the state of separation. The following marks show the degree of agglutination.

O: no problem of agglutination,

Δ: some agglutination,

X: remarkable agglutination

Referential Example 1

Four parts of an AN fiber (single filament denier: 3 d, filament length: 3 mm, inherent viscosity in dimethylformamide at 30° C.: 1.3) composed of 90% AN and 10% methyl acrylate (MA) was immersed in 96 parts of an aqueous 30% caustic soda solution, and the solution was boiled for 10 minutes under stirring. Then an aqueous sulfuric acid solution was added to bring the pH to 3. Thereafter, by centrifugal dehydration, fiber (a) (degree of neutrization: 0) was produced.

Two kinds of fibers (b and c) were produced in the same way as above except that the boiling time was changed.

The degree of water-swelling, the quantity of carboxyl groups, and the proportion of hydrophilic cross-linked polymer (I) were measured. The results are shown in Table 1.

TABLE 1

| Fiber | Degree of water-swelling (times) | Quantity of carboxyl groups (m mol/g) | Proportion of polymer (I) (%) |
|---|---|---|---|
| a | 1.1 | 2.2 | 30 |
| b | 1.0 | 0.8 | 10 |
| c | 1.0 | 0.4 | 5 |

Referential Example 2

Fibers (a, b, c) of Referential Example 1 were neutralized with aqueous sodium hydrogen carbonate solutions of various concentrations to produce 9 kinds of fibers (d-1) having different degrees of neutralization.

The paper-making properties of these fibers were evaluated, and the results are shown in Table 2.

TABLE 2

| Fiber | Quantity of carboxyl groups (m mol/g) | Degree of neutralization | Degree of water-swelling (times) | Paper-making properties* |
|---|---|---|---|---|
| d | 2.2 | 0.05 | 19 | Δ |
| e | 2.2 | 0.1 | 36 | X |
| f | 2.2 | 0.3 | 71 | X |
| g | 0.8 | 0.1 | 15 | Δ |
| h | 0.8 | 0.3 | 33 | X |
| i | 0.8 | 0.6 | 32 | X |
| j | 0.4 | 0.1 | 3 | O |
| k | 0.4 | 0.3 | 7 | X-Δ |

TABLE 2-continued

| Fiber | Quantity of carboxyl groups (m mol/g) | Degree of neutralization | Degree of water-swelling (times) | Paper-making properties* |
|---|---|---|---|---|
| l | 0.4 | 0.6 | 7 | X |

*O: no problem

Δ: some problems in water filtration, ect.

X: paper-making impossible

Referential Example 3

After subjecting the fibers (a, b, c) of Referential Example 1 to wet system paper-making process in the usual way (the weight per area of the resulting paper being 75 g/m$^2$), the paper was neutralized in the same way as in Referential Example 2 to produce 10 kinds of sheets (m-v).

The characteristic properties of these sheets were measured and evaluated, and the results are shown in Table 3.

TABLE 3

| Sheet | Kind of fiber | Degree of neutralization | Degree of water-swelling (times) | Degree of agglutination |
|---|---|---|---|---|
| m | a | 0.05 | 18 | O |
| n | a | 0.1 | 34 | X-Δ |
| o | a | 0.3 | 62 | X |
| p | a | 0.6 | 69 | X |
| q | b | 0.1 | 14 | O |
| r | b | 0.3 | 31 | X |
| s | b | 0.6 | 30 | X |
| t | c | 0.1 | 3 | O |
| u | c | 0.3 | 6 | X-Δ |
| v | c | 0.6 | 6 | X |

Example of Practice 1

An aqueous 9% sodium hydrogen carbonate solution was sprayed to sheets produced in the same way as in Referential Example 3 from fibers (a, b, c) of Referential Example 1 (the quantity of the adhering salt was so changed that the degree of neutralization at the time of complete consumption of the salt by netralization could become the degree of neutralization shown in Table 4). The sheets were then dried by means of a drum drier at 100° C. for one minute to produce 11 kinds of sheets (1–11).

The degree of water-swelling and degree of agglutination of these sheets were measured and evaluated. The results are shown in Table 4.

TABLE 4

| Sheet no. | Kind of fiber | Degree of neutralization | Degree of water-swelling (times) | Degree of agglutination |
|---|---|---|---|---|
| 1 | a | 0.05 | 17 | O |
| 2 | a | 0.1 | 32 | O |
| 3 | a | 0.3 | 61 | O |
| 4 | a | 0.6 | 64 | Δ-O |
| 5 | a | 0.8 | 63 | Δ |
| 6 | b | 0.3 | 30 | O |
| 7 | b | 0.6 | 30 | O |
| 8 | b | 0.8 | 29 | Δ |
| 9 | c | 0.3 | 6 | O |
| 10 | c | 0.6 | 6 | O |
| 11 | c | 0.8 | 6 | Δ |

From the above Table, it is apparent that the products of this invenion can display excellent water-swelling performance and has no problem in the agglutination among filaments.

Example of Practice 2

Sheet No. 12 was produced in the same way as Sheet No. 2 except that sodium carbonate was used instead of sodium hydrogen carbonate.

The degree of water-swelling of this sheet was 62 times and also there was no problem in the agglutination among filaments.

When ammonia was used instead of sodium hydrogen carbonate, the degree of water-swelling was 62 times but agglutination among filaments was observed.

Example of Practice 3

Paper-making was performed in the same way as in Referential Example 3 except that Fiber (a) of Referential Example 1 and craft pulp were used in the proportion of 75:25.

To the thus obtained sheets, salt solutions were sprayed in the same way as in Exampe of Practice 1 (however the kind of salt and the degree of neutralization were changed as shown in Table 5) and 6 kinds of sheets (13-18) were produced.

The results of evaluation of these sheets are shown in Table 5.

TABLE 5

| Sheet no. | Kind of salt | Degree of neutralization | Degree of water-swelling (times) | Degree of agglutination |
|---|---|---|---|---|
| 13 | $NaHCO_3$ | 0.3 | 47 | O |
| 14 | $NaHCO_3$ | 0.6 | 46 | O |
| 15 | $NaHCO_3$ | 0.9 | 41 | O |
| 16 | $Na_2CO_3$ | 0.3 | 42 | O |
| 17 | $Na_2CO_3$ | 0.6 | 50 | O |
| 18 | $Na_2CO_3$ | 0.9 | 49 | O |

What we claim is:

1. A water-swellable fiber exhibiting a degree of water swelling of 3 times or more and satisfying the following requirements (a)–(f):
   (a) it is composed of a hydrophilic crosslinked polymer (I) and another polymer (II),
   (b) it has a cross-sectional structure such that at least a part of the polymer (I) is situated as an outer layer,
   (c) the proportion of the polymer (I) is not larger than 60% based on the total volume of the fiber,
   (d) it contains and links carboxyl groups thereto in a quantity of from 0.3 to 4.0 m mol/g,
   (e) the degree of neutralization of the carboxyl groups is less than 0.1, and
   (f) the degree of water swellability is 10 times or less, by causing to adhere to said fiber such a quantity of carbonate or hydrogen carbonate whose cationic component is an alkali-metal as to make the degree of neutralization of the carboxyl groups from 0.1 to 0.7.

2. A water-swellable polyacrylonitrile fiber exhibiting a degree of water swelling of 3 times or more and satisfying the following requirements (a)–(f):
   (a) it has a cross-sectional structure having an outer layer of a hydrophilic crosslinked acrylonitrile polymer (I) and a core of an uncrosslinked acrylonitrile fiber (II),
   (b) the proportion of the polymer (I) is not larger than 60% based on the total volume of the fiber,
   (c) it contains and links carboxyl groups thereto in a quantity of from 0.3 to 4.0 m mol/g,
   (d) the degree of neutralization of the carboxyl groups is less than 0.1, and
   (e) the degree of water swellability is 10 times or less, by causing to adhere to said fiber such a quantity of carbonate or hydrogen carbonate whose cationic component is an alkali-metal as to make the degree of neutralization of the carboxyl groups from 0.1 to 0.7.

* * * * *